US009669979B2

(12) United States Patent
Perl et al.

(10) Patent No.: US 9,669,979 B2
(45) **Date of Patent: *Jun. 6, 2017**

(54) SECONDARY PACKAGING COMPRISING A PLURALITY OF ARTICLES OR CONTAINERS AND METHOD FOR PRODUCING SUCH A PACKAGE

(71) Applicant: KRONES Aktiengesellschaft, Neutraubling (DE)

(72) Inventors: Kurt Perl, Rimsting (DE); Michael Hartl, Raubling (DE)

(73) Assignee: Krones Aktiengesellschaft, Neutraubling (DE)

( * ) Notice: Subject to any disclaimer, the term of this patent is extended or adjusted under 35 U.S.C. 154(b) by 95 days.

This patent is subject to a terminal disclaimer.

(21) Appl. No.: 14/476,422

(22) Filed: Sep. 3, 2014

(65) Prior Publication Data

US 2015/0314935 A1 Nov. 5, 2015

Related U.S. Application Data

(63) Continuation of application No. 12/998,966, filed as application No. PCT/EP2010/065638 on Oct. 18, 2010, now Pat. No. 8,851,285.

(30) Foreign Application Priority Data

Oct. 16, 2009 (DE) ..... 10 2009 044 271

(51) Int. Cl.
*B65D 65/00* (2006.01)
*B65D 75/00* (2006.01)
(Continued)

(52) U.S. Cl.
CPC ..... *B65D 75/02* (2013.01); *B65D 71/0085* (2013.01); *B65D 71/02* (2013.01); *B65D 71/50* (2013.01)

(58) Field of Classification Search
CPC .... B65D 71/506; B65D 71/504; B65D 71/50; B65D 2571/0024; B65D 75/02; B65D 71/0085; B65D 71/02
(Continued)

(56) References Cited

U.S. PATENT DOCUMENTS 3,330,408 A 7/1967 Wanderer ..... 206/65
3,388,791 A 6/1968 Walsh ..... 206/162
(Continued)

FOREIGN PATENT DOCUMENTS

CN 101102941 5/2010
DE 1 457 489 A 11/1971
(Continued)

*Primary Examiner* — Jacob K Ackun
*Assistant Examiner* — Rafael Ortiz
(74) *Attorney, Agent, or Firm* — Davidson, Davidson & Kappel, LLC

(57) ABSTRACT

A pack including at least two articles or PET containers combined with each other, which are held together by means of a strip-like or ribbon-like compact strapping and said strapping being stretched around an outer surface of the articles or PET containers in a horizontal manner. The strapping is made of one, two or more similar or different plastic strapping band or bands made of a composite material with overlapping ends each whereby a single part or multi part contact point is formed by gluing and/or welding. The strapping forms a relief loop at the contact site or apart from the contact site.

4 Claims, 5 Drawing Sheets

(51) Int. Cl.

| | |
|---|---|
| ***B65D 75/02*** | (2006.01) |
| ***B65D 71/00*** | (2006.01) |
| ***B65D 71/02*** | (2006.01) |
| ***B65D 71/50*** | (2006.01) |

(58) Field of Classification Search
USPC ..... 206/150, 162, 65, 141, 142, 143, 151, 206/427–435, 139; 53/399
See application file for complete search history.

(56) References Cited

U.S. PATENT DOCUMENTS

| | | | | | |
|---|---|---|---|---|---|
| 3,813,123 | A | | 5/1974 | Owen | 294/87.2 |
| 4,252,344 | A | | 2/1981 | Larsen | |
| 4,628,666 | A | | 12/1986 | Lems | 53/398 |
| 4,828,110 | A | * | 5/1989 | Lems | B65D 71/02 206/150 |
| 4,871,068 | A | * | 10/1989 | Dreyfus | B65D 5/2033 206/200 |
| 4,893,712 | A | * | 1/1990 | Allen | B65D 71/506 206/150 |
| 5,154,288 | A | | 10/1992 | Gloyer | 206/427 |
| 5,570,787 | A | | 11/1996 | Danovaro et al. | 206/428 |
| 5,775,486 | A | * | 7/1998 | Edqvist | B65D 71/42 206/145 |
| 6,039,181 | A | | 3/2000 | Whiteside | 206/428 |
| 6,041,572 | A | | 3/2000 | Gandini | |
| 6,358,586 | B1 | | 3/2002 | Fujita et al. | |
| 7,798,320 | B2 | | 9/2010 | Pham | |
| 8,061,750 | B1 | * | 11/2011 | Hamilton | A45C 13/30 294/149 |
| 2004/0055905 | A1 | | 3/2004 | Marco et al. | |
| 2004/0178636 | A1 | | 9/2004 | Iwanami et al. | |
| 2005/0086910 | A1 | | 4/2005 | Chambers et al. | |
| 2005/0109640 | A1 | | 5/2005 | Marco | |
| 2005/0150783 | A1 | | 7/2005 | Ogg | |
| 2006/0213788 | A1 | * | 9/2006 | Juneau | B65D 81/3222 206/222 |
| 2006/0255006 | A1 | | 11/2006 | Wagenknecht et al. | |
| 2008/0272013 | A1 | * | 11/2008 | Hartness | B29C 63/423 206/139 |
| 2009/0266732 | A1 | | 10/2009 | Hartl | 206/432 |
| 2011/0089055 | A1 | | 4/2011 | Perl et al. | 206/139 |

FOREIGN PATENT DOCUMENTS

| | | | |
|---|---|---|---|
| DE | 69311338 | T2 | 12/1997 |
| DE | 20 2004 011166 | U1 | 9/2004 |
| DE | 20 2006 000215 | U1 | 3/2006 |
| DE | EP 1 886 921 | A1 | 2/2008 |
| DE | 20 2008 005594 | U1 | 7/2008 |
| DE | 10 2008020522 | A1 | 10/2009 |
| EP | 1 42360 | A2 | 5/1985 |
| EP | 0 392 996 | A1 | 10/1990 |
| JP | 10059379 | | 3/1998 |
| WO | WO 89 07075 | A1 | 8/1989 |
| WO | WO9506604 | | 3/1995 |

* cited by examiner

SECONDARY PACKAGING COMPRISING A PLURALITY OF ARTICLES OR CONTAINERS AND METHOD FOR PRODUCING SUCH A PACKAGE

This is a Continuation of U.S. patent application Ser. No. 12/998,966, filed Jun. 20, 2011 which is a National Phase Application of PCT/EP2010/065638, filed Oct. 18, 2010 which claims priority to German Patent Application DE 10 2009 044 271.5, Oct. 16, 2009, all of which are hereby incorporated by reference herein.

The present invention relates to a pack of several articles or containers and a method for the production of a pack by the application of a strapping.

BACKGROUND

Different possibilities regarding the combination of single articles into larger packs are already known. Beverage containers are, for example, combined and packed to packs of four, six or more containers mostly by means of shrink films. The production of packs is usually necessary, since packs are the most frequently used sales units for beverage container and bottles made of PET plastics. The packs are in parts combined once more for transport purposes and/or arranged in layers and palletized.

The shrink films used for the production of known packs are themselves produced in certain production steps which require a relatively high need of energy. Besides, the used film causes high production costs, costs for supply and for the handling as well as for later disposal, since said films are no longer needed after the sale. Likewise, the machinery equipment for the supply of the so called film wrapping modules and other handling stations causes high investment costs. Finally, the supply of the so called shrinking tunnel, wherein the film, which is wrapped around the packs, is shrunk around the bottles by means of hot air supply, also requires relatively major capital investment.

Furthermore the containers can be held together and combined with each other to one pack by means of a so called strapping. The strapping pulls the containers together, thereby stabilizing the pack. To take containers out of the pack, the pack needs to be opened by severing the strapping from the pack. The strapping is usually either pulled off or cut off. To guarantee a stabile pack the strapping is applied around the containers with a certain tension or pre-stress. Because of this applied pre-stress the strapping tends to loosen in a whip-like manner. This can be very inconvenient for the person opening the pack. It is furthermore unpractical for the user that the strapping can only hardly be released or severed without the help of additional tools.

A pack made from several bottles is known from DE 1 457 489 A, wherein said bottles are held together by means of endless strips in order to form a package. A handle serves for carrying the package.

A grid like plastic structure for the fixation of beverage containers and for the formation of packs is known from U.S. Pat. No. 3,813,123 A. The structure comprises connecting rips formed as loops that run between the fixation ribbons of the grid and that are used as gripping sections for easily holding the packs.

A further pack arrangement is disclosed in U.S. Pat. No. 5,775,486 A. Rows of three or six bottles or tins are fixed by cardboard pieces in combination with strapping bands, thereby forming bigger packs. The cardboard pieces are hereby placed on top of the bottles or tins.

SUMMARY OF THE INVENTION

An object of the present invention is to provide a cost-saving, stable and easy manageable pack arrangement which avoids at least partially the mentioned disadvantages of the prior art. The handling of the pack shall be especially comfortable, for instance by easing the handling of the separable strapping bands that hold the pack together.

The present invention provides a pack, whereby the pack comprises at least two articles combined with each other. The articles can be beverage containers, PET-containers or the like. The at least two articles are held together by means of a strip-like or ribbon-like compact strapping, wherein said strapping is spun or stretched around an outer surface of the articles or containers in a horizontal manner. The strapping is made of one, two or more similar or different plastic bands or bands made from a composite material. The ends of the band or bands are overlapping and are glued and/or welded together thereby forming a single part or multi part contact site. According to the invention the strapping comprises at least one loop that acts as a relief loop or as a so called compensator. The strapping optionally comprises at least one loop at the contact site and/or spaced apart from the contact site.

According to a first embodiment of the pack at least one band of the strapping has at least two distinct joints and a relief loop situated in between the two joints at the contact site of the two ends of the band. In this embodiment the loop between the two joints preferably points towards the inside of the pack. The loop especially points towards the containers or articles that are held together by the strapping. Optionally and in an alternative embodiment the relief loop can also point towards the outside of the pack, depending on the design of the contact site and the two joints.

Preferably the releasing force for opening the first joint that unilaterally borders a pull off handle is smaller than a releasing force for opening the second joint, whereby the second joint is separated from the first joint by the relief loop or relief flap. In this way it can be guaranteed that the first joint always weakens and tears off first, whenever the pull off handle is pulled manually. While the relief loop is tightening up, the tension of the strapping band is relieved. Because it shows a higher resistance, the second joint can only be opened and torn up after the first joint has been opened.

According to a second embodiment of the pack, the contact site of the two ends of at least one band of the strapping comprises at least two distinct or immediately adjacent joints, which are bordered by a relief loop that points towards the pack. The relief loop is located immediately adjacent to the articles or PET containers. The relief loop is formed by an end section of the strapping band, whereby the end of the strapping band is folded once. The other end of the band is superimposed on this folded end section and joined to the outer side of the first end of the band, thereby forming an inner loop and a contact site.

Preferably the releasing force for opening the joint that unilaterally borders the pull off handle is smaller than a releasing force for opening the other joint that is immediately adjacent to the relief flap, whereby this other joint is at least slightly distanced from the joint bordering the pull off handle. In this way it can be guaranteed that the first joint always weakens and tears off first whenever the pull off handle is pulled manually. While the relief flap is tightening up, the tension of the strapping is released. Because it shows a higher resistance, the second joint can only be opened and torn up after the first joint has been opened.

A third embodiment according to the invention provides that at least one band of the strapping shows something like a loop, whereby the loop is located at a distance from the contact site of the two ends of the strapping band. Hereby the band is folded twice or superimposed on each other. The three band sections that are arranged on top of each other are fixed to each other especially by welding or gluing. In this embodiment an inner loop section forms the relief loop, whereby the inner loop section is pointing towards the pack and whereby the inner loop section is bordered by the joint.

In all embodiments it can be provided that a protruding outer loop section, which is pointing away from the pack and which is bordering the joint, forms a pull off flap for opening the strapping. An end of the band that is protruding over the contact site of the strapping ends, which are welded or glued together, can optionally form a pull off handle. For easier handling it might be advantageous if the contact site and/or the joint of the three fold superimposed band loops comprise a structured adhesion site and/or welding site. The structured adhesion site and/or welding site influence and/or facilitate the detachment process.

As already described above, the loop located between the two joints can be formed on the inside or the outside of the strapping enclosing the pack. The strapping can be made from one, two or several similar or different plastic bands or bands made from a composite material, whereby the ends of the band or bands are overlapping each other or whereby the ends of the band or bands directly contact each other and are glued together, welded together, clamped together, knotted together or joined together in another suitable manner.

In the context of the invention an application device is also described. The application device is used for the application and fixation of at least one horizontal strapping around at least two articles, for instance PET containers, thereby joining the articles in a pack according to one of the previously described embodiments. The articles in the pack are held together by a closed, pre-stressed, horizontal strapping that is applied around the outer surface of the articles or PET containers. The strapping is made from at least one plastic band or one band of a composite material. The ends of the strapping are overlapping each other and a one-piece or multiple-piece contact site is formed by gluing and/or welding the ends together. When the strapping is applied onto the articles by the application device, a loop is formed in the strapping at the contact site or a loop is formed in the strapping spaced apart from the contact site. By using several punching means and towing means, whereby the movements of the punching means and towing means are coupled, each desired variation of a relief loop can be produced and joined to the strapping. The fixation of the relief loop is usually done by shortly heating the band, whereby a defined pressure is applied onto the band. This leads to a welding of the band at the contact site as well as to the fixation required for the production of the relief loop or compensator. The application device can for instance comprise three or more retaining means or lifting means for the fixation, welding and/or adhesion of the band ends, for the formation of the loops and/or relief flaps or tears off flaps. The relief loop is produced by means of a controllable tilting lever or the like. At least one neighboring band section is fixed meanwhile another band section can slide through the other side of the application device. After tightening the band, it can be welded together. This is preferably done by a further component of the application device, typically a heating finger or the like, whereby the band is pressed and heated at the same time to produce the desired welded joint.

The present invention furthermore relates to a method for the production of a pack according to one of the previously described embodiments. First the strapping is introduced into a guiding frame that is placed around the containers or articles to be held by the strapping. The band is clamped by the application device at one position and the relief flap is formed. The chronological order of the procedural steps can be changed for instance the loop can also be formed first and then the band is clamped at a suitable position. The band is pulled back for a defined distance and thereby stretched. Then the band is clamped at the other site of the relief flap formed beforehand. After that the band is welded at the right site and released from the application device by removing the application device from the band. Further variations of the method can be gathered from the previously described embodiments of a pack strapping and from the variations described below. In this context we also refer to the description of the drawings that furthermore explains one embodiment of the application device as well as an embodiment of the inventive method for the application of a strapping comprising a relief flap.

In the following, some further aspects of the pack according to the invention are being explained by means of different possible embodiments. A pack comprises for instance two, preferably four, or even five, six, seven or more joined PET containers that are held together by means of a horizontal strip- or ribbon-like strapping stretched around an outer surface of the PET containers in a horizontal manner. The strapping is preferably applied to the PET containers and fixed onto the PET containers during a continuous conveying process. During the application of the strapping, the PET containers are normally not being stopped or the conveyance process is not delayed since the strapping can be applied around said PET containers in a continuous process during the continuous conveyance of the PET containers. If necessary an inner surface of the strapping, which lies against the outer surfaces of the PET containers, can firmly be fixed to one of the PET containers at one joint. Thus, the strapping can be fixed at the joint particularly by means of a composite connection in the form of at least one welded joint. When such a joint is applied between at least one container and the strapping, the PET containers in the pack cannot shift; therefore a defined packaging arrangement can be maintained. Optionally this additional fixation can also be omitted. Then a shifting of the containers in the above-mentioned way, particularly after the application of the loop-like carrier handle, is furthermore possible. It also makes sense to carry out the fixation after the determination of the final arrangement of the containers in the pack and after the application and the correct placement of the carrier handle, so that the chosen arrangement can be retained in a reliable manner.

The optional welded joint can for example be a sonic weld joint or a laser weld joint or the optional welded joint can be made by another suitable welding technique. If thermoplastic or thermoplastic polymer respectively is used, the material must be melted or at least softened at the desired welding site by means of a heat supply, in order to enable the production of a material integrated bond at the contact site by welding. When making an ultrasonic weld, the polymers are joined together by means of mechanical vibrations. The main feature of this method is that the heat necessary for welding the components together is developed by molecular friction and surface friction in the components themselves.

The strapping is made from at least one flat band which is spun or stretched around the outer surfaces of the PET containers and which is afterwards connected at its ends in a pre-stressed manner. The PET containers are combined and held together with said spun strip-like or ribbon-like compact strapping so that they can be transported safely. The strapping can also be made of two or more bands running in parallel. Thus, the strapping is produced from one, two, or more similar or different bands made of polymer or a composite material, wherein the bands are connected with each other at their ends by means of gluing, welding, cramping, knotting or else. The ends can thereby be arranged overlapping each other or the ends can directly contact each other without any overlap. An advantageous embodiment can be formed by welding the overlapping ends of the strapping together. Besides it is possible that said ends are welded to at least one PET container of the pack by means of one welding site, so that the PET containers are secured in their formation during their transport. Thus the containers of the pack cannot be shifted into different types of formation, such as from a longitudinal formation into a diagonal formation, for instance.

The PET containers held together to form a pack can be provided in each case with notches and said notches circulating in an annular form and/or extending in an horizontal direction for receiving and/or fixing the strapping, if necessary. With such a notch, an additional fixation of the strapping can be provided, since the applied strapping is thus fixed in the horizontal position. Furthermore, the PET containers held together to form a pack are in each case provided with a container neck underneath a top side opening, wherein a further strapping for fixing the PET containers can be provided on said container neck. Each of these mentioned alternatives of strapping can be additionally provided, if necessary, with at least one welding site on at least one PET container of the pack. This welding site can be made during the production of the pack respectively, so that the mutual shifting of the containers against each other can be prevented reliably.

The use of a recyclable material as a strapping and/or carrier handle is particularly advantageous, wherein said recyclable material consists e.g. of pure thermoplastic polymer. Biologically degradable material can also be used, wherein said biologically degradable material can also be used as composite material with thermoplastic polymer and/or with a fiber reinforcement added to the biologically degradable material if necessary. A further advantage of the invention contrary to known alternatives from the prior art is amongst other things, that the strapping as well as the carrier handles are less expensive with regard to production costs than a film. Said strapping can also be processed more easily than a film. No shrinking tunnel is necessary, which results in high energy saving and a reduction of the investment costs.

PP- or PET plastics have proven to be a suitable strapping material. If PP plastic is used, it can be reinforced by the addition of fibers to provide it with the required strength and stability. This is especially required when using very thin bands with a thickness of just about 0.65 mm and a width of about 8 mm. The use of PET plastic can be advantageous because this material shows favorable mechanical properties. PET only slightly loosens its applied pre-stress because it only shows slight plastic deformations. A PET band can for instance have a thickness of about 0.3 mm to 0.5 mm and a typical width of about 8 mm to 10 mm. The strength of the one PET band can be sufficient for holding the pack.

The advantageous aspect of the invention is to be found in the improved strapping, which is provided with a so called compensator or relief loop for relieving the pre-stress during the removal of the strapping from the containers. To produce said compensator or relief loop, the joints of the two overlapping ends of the strapping are created in a way, that the ends of the strapping are not positioned concisely beside each other between the two distanced joints, but that one end of the strapping is slightly too long. The end of the strapping that is slightly too long is especially protruding over the joint. In this way, a sort of loop is being formed, whereby the two sections of the strapping, which are superimposed over each other, are slightly lifting off from each other. If the strapping is removed by peeling off one overlapping or protruding end, the welding site is first split open at this protruding end. Due to this fact, the strapping band, which is under high pre-stress, first slackens a slight amount. The required amount of band required for the slackening is provided by the compensator. The now slackened strapping is completely opened and removed by splitting open the second welding site only afterwards. Since the strapping is normally applied with a relatively high pre-stress, their removal is frequently connected with a sudden loosening, which is regarded as inconvenient by many users, since the strapping can also sometimes spring off the pack in a whip-like manner. The alternative embodiments described above (especially the second embodiment and the third embodiment) are designed differently. Nevertheless the same desired effect is reached; especially the described packs allow an easy and comfortable handling and removal of the strapping by the user without the use of any additional tools.

Because one of the protruding ends forms a sort of pull off handle of the compensator, it might be further advantageous if at least the contact site facing the protruding end has a structured adhesion site or welding site for influencing and/or facilitation of the detachment process. The welding or the adhesion at the contact site can for instance show a suitable structuring, interruptions and/or suitable shape, which contributes in creating a relatively low and mostly uniform detachment force. The contact site can for instance show a strip-like, parabolic adhesion pattern and/or welding pattern that is detachable from its rounded peak along both parabola edges.

Further features and advantages of the present invention shall now be described in greater detail according to the accompanying figures in the following detailed description. The dimensions of the individual elements to each other do not always correspond with the real dimensions since some forms are shown simplified and other forms are shown enlarged with respect to other elements for the sake of clarity.

DETAILED DESCRIPTION

The following detailed descriptions of the drawings of possible embodiments according to the invention are only examples and shall not be regarded as limiting the invention. Same elements refer to same reference numbers throughout the various figures. Furthermore, only reference numbers which are necessary for the description of the respective figures are shown in the various figures for the sake of clarity.

The packs or sales units described subsequently unite several articles, especially beverage containers. The packs are formed by providing the containers with a strapping made of flexible plastic bands or bands of another material, especially PP or PET. With the type of connection shown here, which is referred to as container strapping, all thinkable geometric arrangements of the containers are possible: linear matrix arrangement in a n times m-arrangement of lines and columns connecting round or rectangular, cubic or other containers as well as, for example, spherical packing with an angle of approximately 30° and 60° degrees respectively with round containers in any number. The arrangement of the packs or containers depends on the feeding of the containers to a so called container divider and the division of the containers by the container divider.

Figure 1:
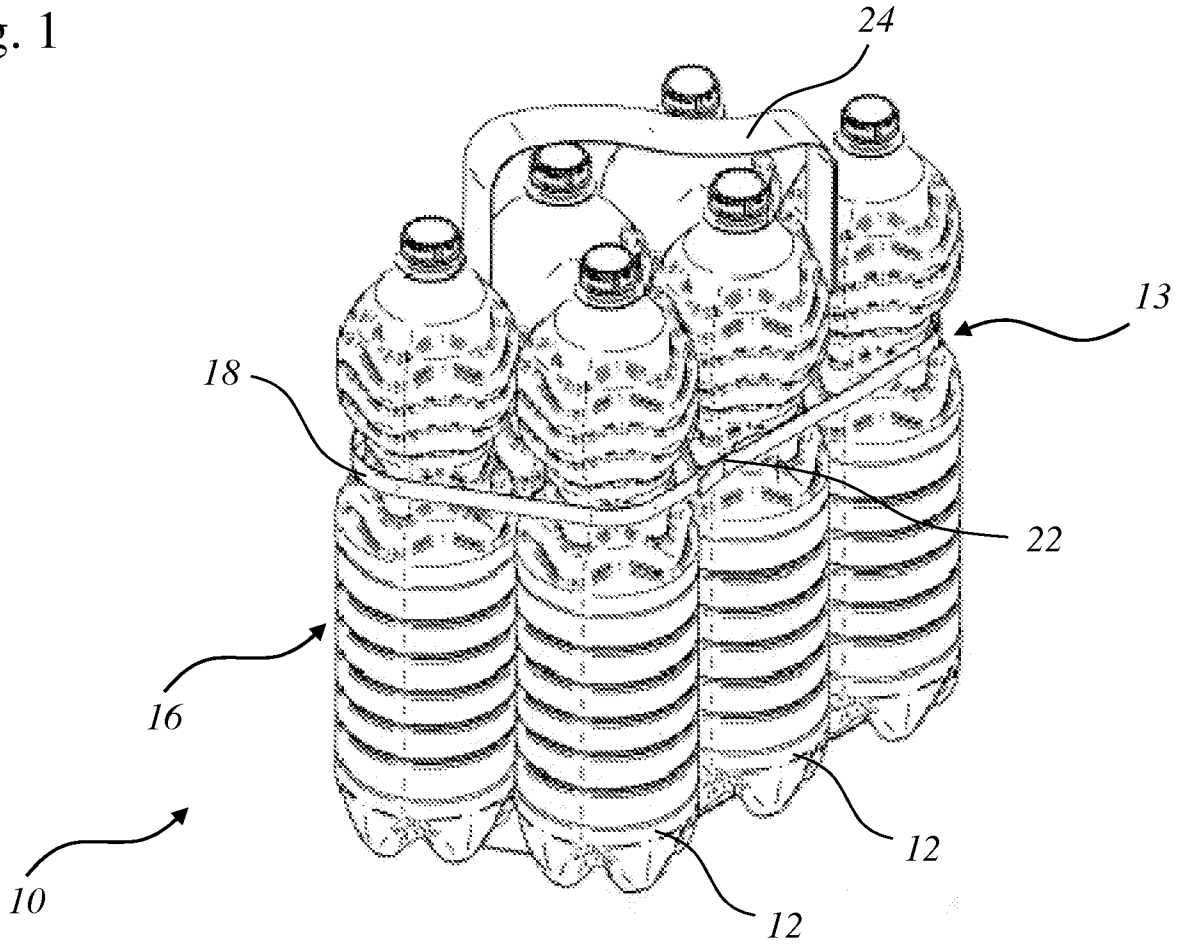
FIG. 1 shows a perspective view of a pack in a diagonal arrangement, wherein said pack is provided with a horizontal strapping and a carrier handle.

FIG. 1 shows a perspective view of such a pack 10. As for the pack formations, containers 12 are arranged next to each other in a so called longitudinal formation 14. In the represented example the pack 10 consists of six PET containers 12 connected with each other. The containers 12 are held together by means of a ribbon-like or strip-like compact strapping 18, which is spun or stretched around the outer surface 16 of the PET containers 12 in a horizontal manner. The strapping 18 is spun or stretched around the containers 12. The free overlapping ends of the strapping 18 are fixed to each other while a pre-stress is applied. In the present context this connection is generally referred to as contact site 22. The strapping 18 is fixed at the contact site 22 by means of a material integrated bond, for example in the form of at least one welded bond or glued bond. Optionally a loop-like handle 24 can be provided, which overstretches the top sides of the pack 10 in a slant or diagonal manner. In the shown embodiment the strapping 18 is stretched around an upper section of the containers 12. In this upper section the containers 12 show a so called waisted design with a so called recessed grip 13. The strapping 18 is located in this recessed grip 13.

Figure 2A:
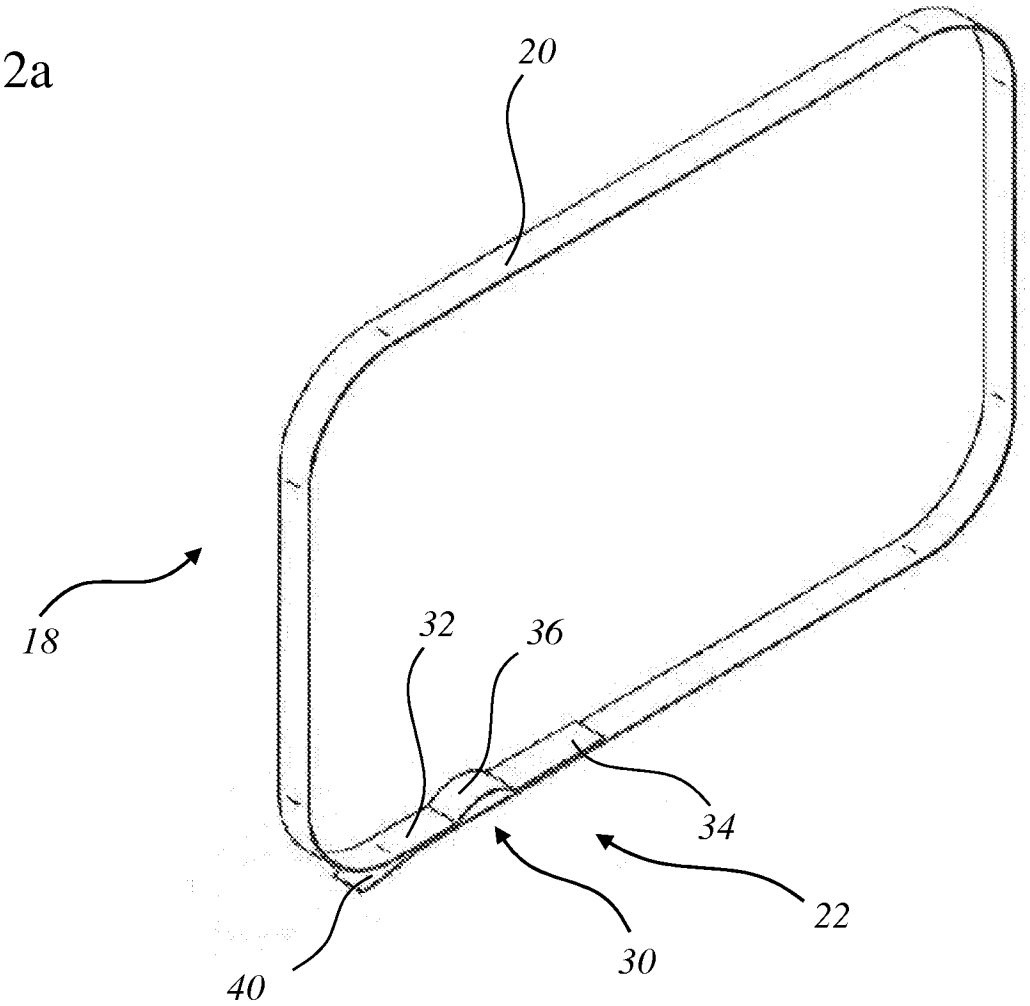
FIGS. 2*a* and 2*b* show two representations of a first variation of the strapping.
Figure 2B:
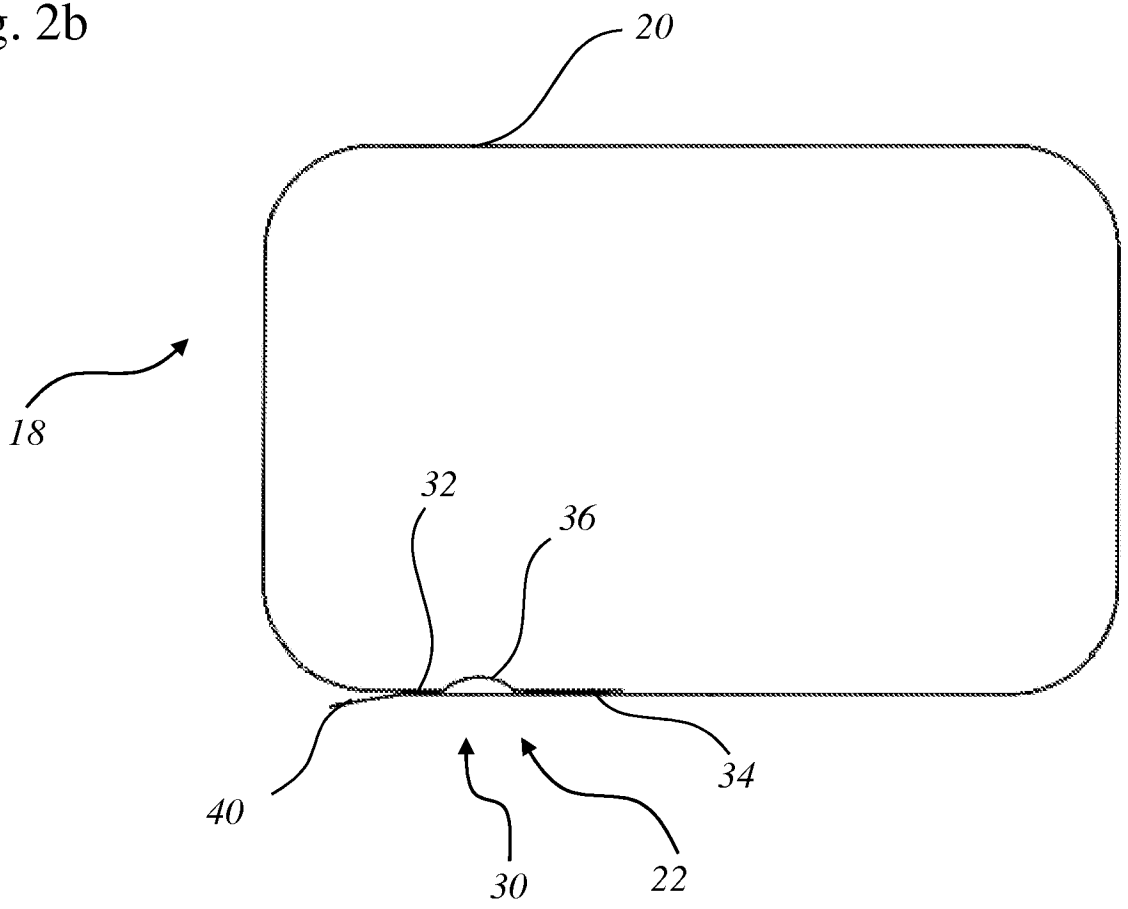

A first embodiment of the strapping 18 according to the invention is shown in FIGS. 2*a* and 2*b*. This first embodiment can also partly be seen in FIG. 1. The embodiment represented in FIG. 2 shows a strapping 18, which comprises a relief loop 30 or a so called compensator in the strapping band 20. The relief loop 30 relieves the pre-stress from the strapping 18 or the strapping band 20, when the strapping 18 or the strapping band 20 is removed from the containers 12. This relief loop 30 or relief flap 36 or compensator is formed at a contact site 22. The contact site 22 comprises two joints 32 and 34. At the joints 32 and 34 the abutting and overlapping band ends are joined respectively, especially where the abutting or overlapping ends of the strapping band 20 are welded together. The two joints 32 and 34 of the two overlapping ends of the strapping band 20 are spaced apart from each other and can especially be formed by welding. The two joints 32 and 34 are formed in a way that the ends of the strapping band 20 between the two joints 32 and 34 are not arranged concisely beside each other. Instead one of the ends is slightly too long, especially protruding. In this way a sort of flap 36 is formed, whereby the two sections of the strapping 18 superimposed on each other are slightly lifted off each other. If the strapping 18 or the strapping band 20 is removed by peeling off one protruding end 40, first the welding site or joint 32 is split open at this protruding end 40. Due to this fact, the strapping band 20, which is in a high pre-stress condition, slackens first about a slight amount. The amount required for the slackening is provided by the compensator. Only afterwards the now slackened strapping 18 is completely opened and removed by splitting open the second welding site or joint 34. Since the strapping bands 20 are normally applied with a relatively high pre-stress, their removal is frequently connected with a sudden loosening, which is regarded as inconvenient by many users, since the strapping band 20 can also sometimes spring off the pack in a whip-like manner, due to its sudden relaxation. This can be reliably prevented by a first embodiment of the relief loop 30 (compensator) according to FIG. 2.

The two described joints 32 and 34 are preferably welding sites, whereby the releasing force for opening and separating the first welding site or joint 32 is smaller than the releasing force for opening and separating the second joint 34. In this way the welding at the contact site 22 can be gradually separated, whereby the contact area of the joint 32 (shown on the left in FIGS. 2*a* and 2*b*) is detached first. The flap 36 is used as band reservoir for removing the pre-stress from the strapping 18. The second joint 34 can only then be removed by further pulling at the pulling flap 40, thereby separating the contact site 22 completely.

Figure 3:
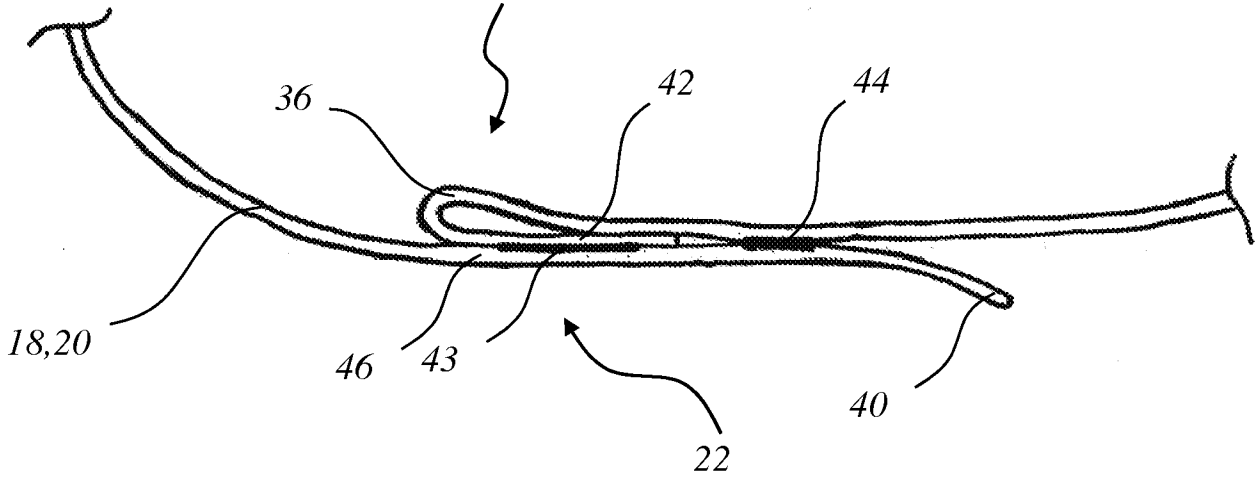
FIG. 3 shows a second variation of the strapping.

The schematic representation of FIG. 3 shows a second embodiment of the relief loop 30 in the strapping band 20. The right end of the band 20 is folded outwardly at the contact site 22 thereby forming the relief loop 30 or a more or less big flap 36. This folded section is first only held in the arrangement but not yet joined, glued or welded. If the need arises, the folded section 42 can be fixed by a so called auxiliary very weak bond or weld. This very weak bond or weld only resists very small forces. Therefore it can be removed easily. The other unfolded end 46 of the strapping band 20 is superimposed on the folded end 42 of the strapping band 20. The overlapping end 40 protruding over the contact site 22 has to have a certain length that allows the production of two joints or welding sites 43 and 44. In the shown embodiment according to FIG. 3 a third joint 43 is produced between the back side of the folded section or the folded end 42 of the strapping band 20 and the unfolded end 46 of the strapping band 20. The third joint 43 is produced in a sufficient distance to the loop 30 thereby forming a relief flap 36 of sufficient size. As represented in the detailed drawing of FIG. 3, the fourth joint 44 is produced at a distance to the third joint 43 between the unfolded end 46 of the strapping band 20 and the right end of the strapping band 20, whereby the fourth joint 44 and the folded end 42 of the strapping band 20 show at least a small distance in between. The section of the band 20 protruding over the fourth joint 44 forms a pulling flap or handle 40 that is required for the manual separation of the strapping 20.

The two joints 43 and 44 are preferably welding sites. The releasing force for opening and separating the fourth joint 44 or welding site is smaller than the releasing force for opening and separating the third joint 43. In this way the welding at the contact site 22 can be gradually separated, whereby the contact area of the fourth joint 44 (shown on the right in the figure) is detached first. The flap 36 is used as band reservoir for removing the pre-stress from the strapping 18. Only then the third joint 43 is removed in the section of the folded end 42 of the strapping band 20 by further pulling at the pulling flap 40 thereby separating the contact site 22 completely.

Figure 4B:
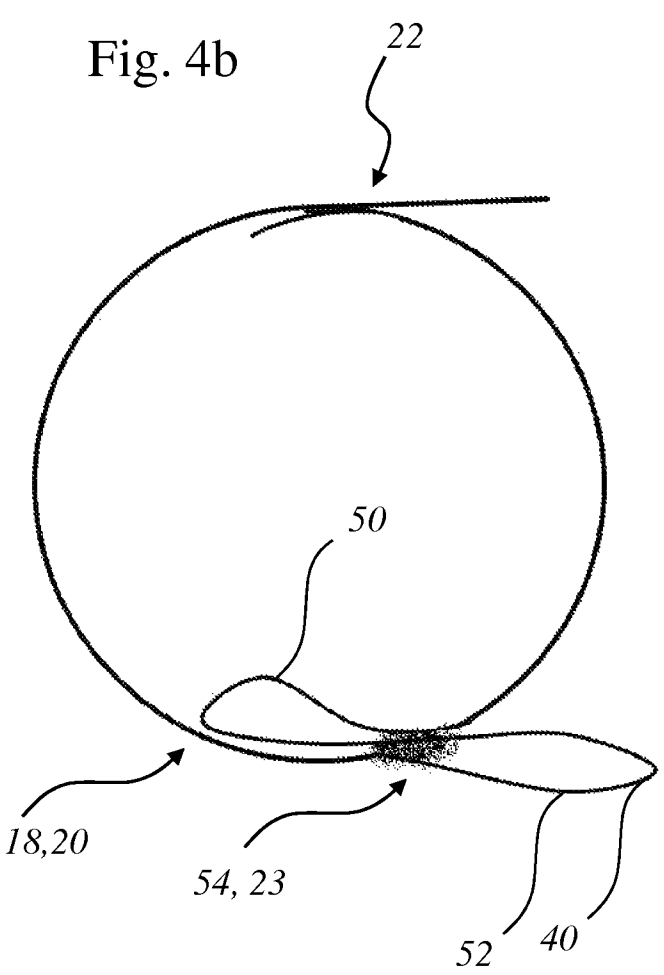
FIGS. 4*a* and 4*b* show two representations of a third variation of the strapping.
Figure 4A:
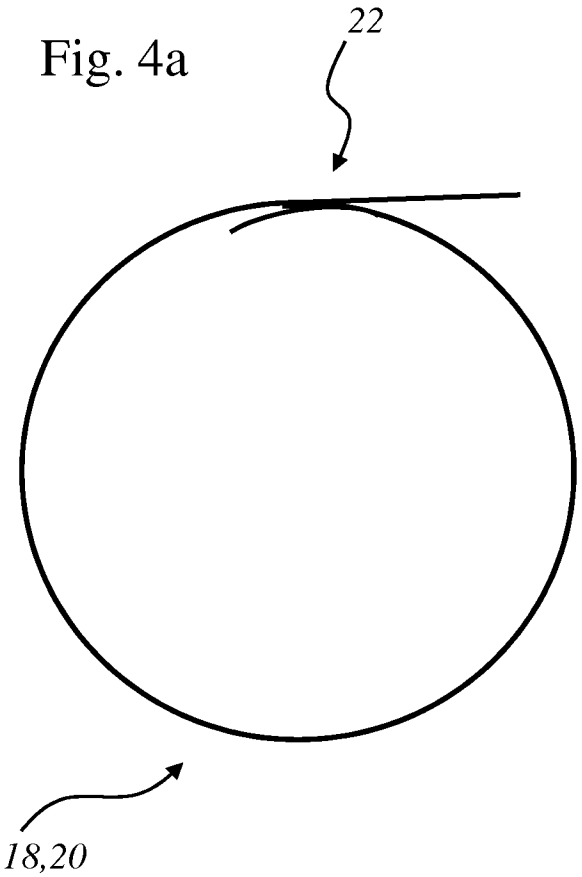

Both representations of FIGS. 4*a* and 4*b* show a third embodiment of a strapping 18. In this embodiment the overlapping ends of the strapping band 20 are not used to form a relief loop 30 at the first contact site 22 (in the top part of FIGS. 4*a* and 4*b*). The relief loop 30 is formed by loops 50 and 52 instead, whereby the loops 50 and 52 are produced by folding the strapping band 20 twice and superimposing the folded sections over each other. This is shown in FIGS. 4*a* and 4*b* on the lower side of the strapping band 20. The common welding 54 at this second contact site 23, whereby the welding 54 comprises three sections of strapping band 20 superimposed onto each other and fixed to each other, also fixes the thereby created loops 50 and 52. The outer loop 52 forms the pulling flap 40 for opening and separating the strapping band 20. The welding 54 is partially loosened at the second contact site 23 by the pulling force, whereby the inner loop 50 is released and pre-stress of the strapping band 20 is removed. The strapping band 20 can now be removed without any problems, either by separation at the first contact site 22 or by lifting off the whole band 20 from the pack 10.

Not shown in the drawings is the application device for the production of the relief flap during joining the ends of the strapping band. Such an application device can for instance comprise one or more clamps for the fixation of the strapping bands during the formation of the loop by lifting a rocking lever. The production of mechanically strong contact sites by welding the strapping bands together can be done with a heating thorn or the like, whereby the heating thorn is inserted at the proper place. Furthermore cam wheels can be used for moving the movable punches and the swiveling lever. The application device can be used for the formation of the contact site 22, thereby applying the pre-stress to the strapping 18. The application device can also be used for the making of the relief loop. The application device comprises several retaining means or lifting means or a tilting lever which are coupled to each other. Basically any desired variation of a relief loop can be produced and introduced into the strapping with these means. The fixation of the relief loop can for instance be done by the heating thorn that is heated shortly and pressed with a defined force to the strapping and to the loop. Thereby the strapping band is welded at the contact site. At the same time the desired fixation for the making of the relief loop or compensator takes place. The application device can for instance comprise three or more retaining means or lifting means arranged beside each other for the fixation, welding and/or adhesion of the ends of the strapping band, for the formation of the loops and/or relief flaps or tear off flaps.

Since in the compensator a protruding end 40 of the strapping band 20 forms a handle, it might be advantageous, if at least the contact site facing the protruding end 40 comprises a structured adhesion site and/or welding site, whereby the structured adhesion site and/or welding site influences and/or facilitates the detachment process. The structured adhesion site and/or welding site is not described here in detail. The welding or bonding can show suitable structures, interruptions and/or other suitable designs that require only a relatively small and uniform releasing force from the user. The contact site can for instance show a glue bonding or welding in a strip-like, parabolic manner. When removing this bonding or welding the separation is done starting from the rounded tip and continuing along the two parabolic edges. Other suitable contours can be used, for instance a meandering course or a plurality of locally limited adhesive spots and/or welding spots that are distanced from each other.

LIST OF REFERENCE SYMBOLS

10 pack
12 article, PET-container
13 recessed grip
16 outside
18 strapping
20 strapping band
22 contact site, first contact site
23 second contact site
24 handle
30 loop, relief loop
32 first joint
34 second joint
36 relief flap
40 end, pulling flap, pulling handle
42 folded end
43 third joint
44 fourth joint
46 unfolded end
50 inner loop
52 outer loop
54 welding

What is claimed is:

1. A pack comprising:

at least two articles combined with each other, whereby the articles are held together by a strapping, the strapping spun or stretched around an outer surface of the articles in a horizontal manner, the strapping being made of at least one plastic band, ends of the band overlapping and forming a single part or multi part contact site by gluing and/or welding the band together, the strapping forming a relief loop at the contact site or apart from the contact site, the relief loop including a pretensioned part of the strapping and a relief flap connected at a first joint of the relief loop to the pretensioned part and at a second joint of the relief loop to the pretensioned part, the relief flap being releasable at least one of the first and second joints, the pretensioned part after release losing tension and the distance of the first and second joints of the relief flap after release gets larger;

wherein the relief loop arranged between the first and second joints points towards the the inside of the pack, so that the relief flap is inwards of the pretensioned part.

2. The pack as recited in claim 1 wherein the at least one band of the strapping has the relief loop arranged between the first and second joints at the contact site between the ends of the band.

3. The pack as recited in claim 1 wherein the relief flap being less tensioned than the pretensioned part prior to release.

4. The pack as recited in claim 1 wherein the relief flap being not tensioned prior to release.

* * * * *